US010347202B2

(12) United States Patent
Huang

(10) Patent No.: US 10,347,202 B2
(45) Date of Patent: Jul. 9, 2019

(54) DRIVING METHOD AND DRIVING DEVICE FOR REDUCING ELECTROMAGNETIC INTERFERENCE

(71) Applicant: Shenzhen China Star Optoelectronics Technology Co., Ltd., Shenzhen, Guangdong (CN)

(72) Inventor: Xiaoyu Huang, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 188 days.

(21) Appl. No.: 15/500,111

(22) PCT Filed: Jan. 18, 2017

(86) PCT No.: PCT/CN2017/071487

§ 371 (c)(1),
(2) Date: Jan. 30, 2017

(87) PCT Pub. No.: WO2018/036097

PCT Pub. Date: Mar. 1, 2018

(65) Prior Publication Data

US 2018/0308440 A1 Oct. 25, 2018

(30) Foreign Application Priority Data

Aug. 25, 2016 (CN) ..... 2016 1 0719242

(51) Int. Cl.
*G09G 3/36* (2006.01)

(52) U.S. Cl.
CPC ..... *G09G 3/3648* (2013.01); *G09G 2310/08* (2013.01); *G09G 2330/06* (2013.01); *G09G 2370/08* (2013.01); *G09G 2370/14* (2013.01)

(58) Field of Classification Search
CPC ..... G09G 3/3648; G09G 2330/06; G09G 2370/08; G09G 2310/08; G09G 2370/14
See application file for complete search history.

(56) References Cited

U.S. PATENT DOCUMENTS

2007/0009163 A1 1/2007 Sasaki et al.
2009/0185579 A1 7/2009 Hong
(Continued)

FOREIGN PATENT DOCUMENTS

CN 101441857 A 5/2009
CN 101499243 A 8/2009
(Continued)

OTHER PUBLICATIONS

Office Action and Search Report for Chinese Patent Application No. 201610719242.5, dated May 31, 2018.
(Continued)

*Primary Examiner* — Viet D Pham

(57) ABSTRACT

Disclosed are a driving method and a driving device for reducing electromagnetic interference. A method for driving a source-chip on film S-COF and a timing controller TCON is provided as: the timing controller TCON first outputs initial data A stored in the source-chip on film S-COF; it is determined whether data received is correct by comparing transmission data received by the source-chip on film S-COF with initial data A built in the source-chip on film S-COF, and if a determination result is no, a swing value of transmission data mini-LVDS is adjusted by the timing controller TCON.

4 Claims, 1 Drawing Sheet

(56) References Cited

U.S. PATENT DOCUMENTS

| | | | | |
|---|---|---|---|---|
| 2009/0284455 | A1* | 11/2009 | Jung | G09G 3/3611 345/87 |
| 2013/0113777 | A1* | 5/2013 | Baek | G09G 3/20 345/212 |
| 2013/0257847 | A1* | 10/2013 | Lee | G09G 5/00 345/213 |

FOREIGN PATENT DOCUMENTS

| | | | |
|---|---|---|---|
| CN | 101996556 | A | 3/2011 |
| CN | 103780246 | A | 5/2014 |
| CN | 103903576 | A | 7/2014 |
| CN | 105448270 | A | 3/2016 |
| CN | 106098017 | A | 11/2016 |
| JP | 2007017802 | A | 1/2007 |
| KR | 20010004897 | A | 1/2001 |

OTHER PUBLICATIONS

Search Report and Written Opinion for International Application No. PCT/CN2017/071487, dated Jun. 5, 2018.

* cited by examiner

DRIVING METHOD AND DRIVING DEVICE FOR REDUCING ELECTROMAGNETIC INTERFERENCE

CROSS-REFERENCE TO RELATED APPLICATIONS

This application claims the priority of Chinese patent application CN 201610719242.5, entitled "Driving method and driving device for reducing electromagnetic interference" and filed on Aug. 25, 2016, the entirety of which is incorporated herein by reference.

FIELD OF THE INVENTION

The present disclosure relates to the technical field of liquid crystal display, and in particular, to a driving method and a driving device for reducing electromagnetic interference.

BACKGROUND OF THE INVENTION

A TFT-LCD (thin film transistor liquid crystal display) device is one of main types of flat display devices, and has become an important display device in modern IT and video products. A main driving principle of the TFT-LCD device is as follows. A system main board connects R/G/B compression signals, control signals and power to a connector on a PCB (printed circuit board) via wires; data is processed by a TCON (timing controller) IC (integrated circuit) on the PCB board, and then the data is connected to an active area via a S-COF (source-chip on film) and G-COFs (gate-chips on film) so as to enable an LCD device to obtain required power supply and signals, as shown in FIG. 1.

In actual development and detection of a product, it is prescribed that an EMI (electromagnetic interference) test should be carried out, which aims to prevent the product from causing bad effects to an article or a human body around it. An essence of the EMI test is to detect energy irradiated by the product in each frequency band. A maximum Swing (a maximum swing of a differential signal relative to a reference voltage) of mini-LVDS communicated between a TCON and an S-COF is strongly correlated to an EMI test result. The greater a swing value is, the higher energy of a frequency point is, and the worse the EMI result is. The smaller the swing value is, the better the EMI result is, but it may result in that the S-COF cannot read data correctly.

SUMMARY OF THE INVENTION

In order to solve the above problem in the prior art, the present application provides a driving method and a driving device for reducing electromagnetic interference.

The driving method for reducing electromagnetic interference of the present disclosure is provided as: when a second chip determines that data transmitted from a first chip is correct and a swing value of transmission data is a minimum value, the first chip and the second chip work with original data transmission parameters.

Preferably, an initial swing value of the transmission data is arranged to be a minimum value, and when the second chip determines the data transmitted from the first chip as incorrect, a swing value of the transmission data is adjusted to a higher-grade value until the second chip determines the data transmitted from the first chip as correct.

Preferably, a criterion for the second chip to determine the data transmitted from the first chip as correct is that data received by the second chip is the same as initial data A built and stored in the second chip.

Preferably, the first chip is a timing controller TCON, and the second chip is a source-chip on film S-COF.

Preferably, driving procedures of the source-chip on film S-COF and the timing controller TCON are as follows. At each time of turn-on, a Lock signal of the source-chip on film S-COF is at a logic voltage low level initially, and the source-chip on film S-COF receives a first row of data transmitted by the timing controller TCON; when data received by the source-chip on film S-COF is different from initial data A built in the source-chip on film S-COF, the Lock signal is still output at the logic voltage low level, and the source-chip on film S-COF continues to receive a next row of data; and when the data received by the source-chip on film S-COF is the same as the initial data A built in the source-chip on film S-COF, the Lock signal is output at a logic voltage high level, and the source-chip on film S-COF works with original data transmission parameters. At each time of turn-on, the timing controller TCON first outputs the initial data A stored in the source-chip on film S-COF; when the timing controller TCON detects that the Lock signal is at a low level, the timing controller TCON adjusts a swing value of transmission data mini-LVDS to a higher-grade value and outputs initial data A again; and when the timing controller TCON detects that the Lock signal is at a high level, the timing controller TCON works with original data transmission parameters and transmits data to the source-chip on film S-COF.

The present disclosure further provides a driving device for reducing electromagnetic interference, which comprises a first chip and a second chip. The first chip is configured to transmit data to the second chip; when it is determined that data read by the second chip is correct, the first chip works with original data transmission parameters; and when it is determined that the data read by the second chip is incorrect, a swing value of transmission data is adjusted to a higher-grade value. The second chip is configured to determine whether the read transmission data is correct and send a determination result to the first chip, and if the determination result is yes, the second chip works with original data transmission parameters.

Preferably, an initial swing value of the transmission data is arranged to be a minimum value.

Preferably, a step of determining whether the read transmission data is correct is specifically: determining whether data received by the second chip is the same as initial data A built and stored in the second chip; if a determination result is yes, the read transmission data is correct; and if a determination result is no, the read transmission data is incorrect.

Preferably, the first chip is a timing controller TCON, and the second chip is a source-chip on film S-COF.

Preferably, a specific driving procedure of the source-chip on film S-COF is as follows. At each time of turn on, a Lock signal is at a logic voltage low level initially, and the source-chip on film S-COF receives a first row of data transmitted by the timing controller TCON; when data received by the source-chip on film S-COF is different from initial data A built in the source-chip on film S-COF, the Lock signal is still output at the logic voltage low level, and the source-chip on film S-COF continues to receive a next row of data; and when the data received by the source-chip on film S-COF is the same as the initial data A built in the source-chip on film S-COF, the Lock signal is output at a logic voltage high level, and the source-chip on film S-COF works with original data transmission parameters. A specific driving procedure of the timing controller TCON is as follows. At each time of turn-on, the timing controller TCON first outputs the initial data A stored in the source-chip on film S-COF; when it is detected that the Lock signal is at a low level, the timing controller TCON adjusts a swing value of transmission data mini-LVDS to a higher-grade value and outputs initial data A again; and when it is detected that the Lock signal is at a high level, the timing controller TCON works with original data transmission parameters and transmits data to the source-chip on film S-COF.

The above technical solution has following beneficial effects. The EMI can be effectively reduced by the driving method and the driving device in the present technical solution, and a procedure of adjusting the swing value in a development process of a product can be simplified, which can accelerate the development progress of the product. In particular, when data mini-LVDS is transmitted between the timing controller TCON and the source-chip on film S-COF, correct data transmission is ensured, and the EMI is reduced.

BRIEF DESCRIPTION OF THE DRAWINGS

The present disclosure will be described in a more detailed way below based on embodiments and with reference to the accompanying drawings. In the drawings.

DETAILED DESCRIPTION OF THE EMBODIMENTS

Figure 1:
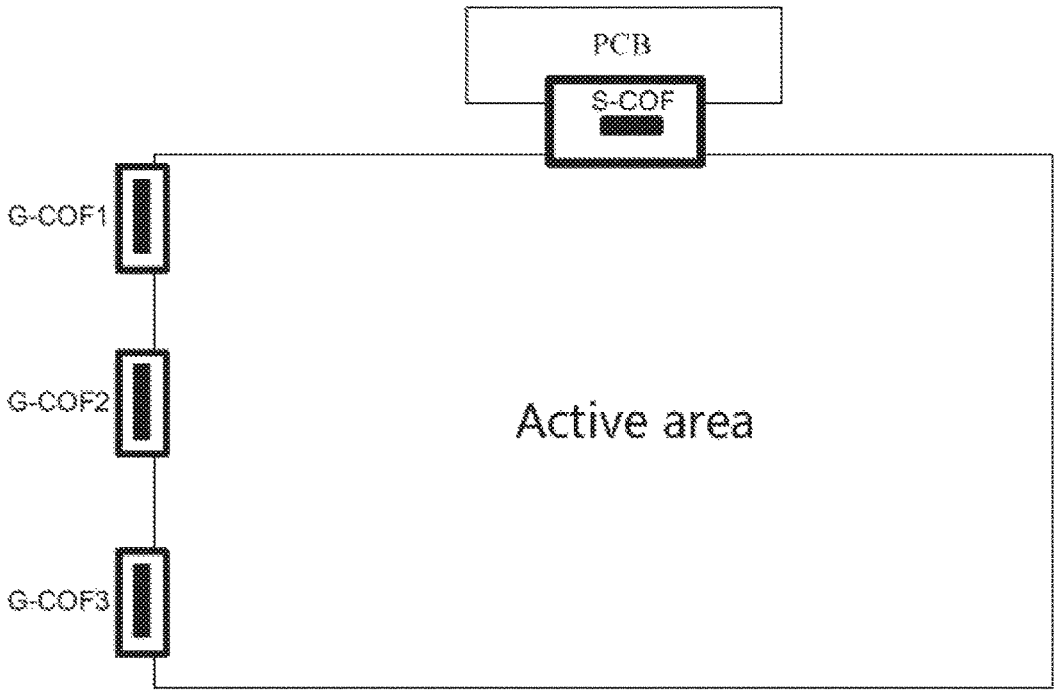
Fig. 1 (Prior Art)
FIG. 1 schematically shows a PCB and an active area in the prior art.

Technical solutions of embodiments of the present disclosure will be clearly and completely described with reference to the drawings, and obviously the embodiments to be described are only exemplary ones rather than exhaustive ones. Based on the embodiments disclosed herein, all other embodiments obtained by one ordinary skilled in the art without making any creative effort fall within the scope of protection of the present disclosure.

It should be noted that, as long as there is no conflict, embodiments of the present disclosure and features therein can be combined with one another.

The present disclosure will be further explained below with reference to the drawings and specific embodiments, but the present disclosure is not restricted by the drawings and specific embodiments.

Embodiment 1

The present embodiment provides a driving method for reducing electromagnetic interference when differential signals are transmitted. The driving method for reducing electromagnetic interference is as follows. When a second chip determines that data transmitted from a first chip is correct and a swing value of transmission data is a minimum value, the first chip and the second chip work with original data transmission parameters.

In a preferable embodiment, an initial swing value of the transmission data is arranged to be a minimum value, and when the second chip determines the data transmitted from the first chip as incorrect, a swing value of the transmission data is adjusted to a higher-grade value until the second chip determines the data transmitted from the first chip as correct.

A criterion for the second chip to determine the data transmitted from the first chip as correct is that data received by the second chip is the same as initial data A built and stored in the second chip. The first chip transmits initial data A, which is the same as the initial data A built and stored in the second chip, to the second chip. By making data comparison, it is determined whether correct data can be transmitted by the first chip. That is, it is determined whether energy of a swing value of the data transmitted is enough to transmit the correct data.

Further, the first chip is a timing controller TCON, and the second chip is a source-chip on film S-COF.

In a preferable embodiment, driving procedures of the source-chip on film S-COF and the timing controller TCON are as follows. At each time of turn-on, a Lock signal of the source-chip on film S-COF is at a logic voltage low level initially, and the source-chip on film S-COF receives a first row of data transmitted by the timing controller TCON; when data received by the source-chip on film S-COF is different from initial data A built in the source-chip on film S-COF, the Lock signal is still output at the logic voltage low level, and the source-chip on film S-COF continues to receive a next row of data; and when the data received by the source-chip on film S-COF is the same as the initial data A built in the source-chip on film S-COF, the Lock signal is output at a logic voltage high level, and the source-chip on film S-COF works with original data transmission parameters. At each time of turn-on, the timing controller TCON first outputs the initial data A stored in the source-chip on film S-COF; when the timing controller TCON detects that the Lock signal is at a low level, the timing controller TCON adjusts a swing value of transmission data mini-LVDS to a higher-grade value and outputs initial data A again; and when the timing controller TCON detects that the Lock signal is at a high level, the timing controller TCON works with original data transmission parameters and transmits data to the source-chip on film S-COF.

In order to ensure that an EMI of the transmitted differential signal has a minimum value, the initial swing value of the differential signal is arranged to be a minimum value. Then, if transmitted data is incorrect, the first chip gradually adjusts the swing value of the transmitted differential signal until correct data is received. When correct data is received, the EMI is has a minimum value which can ensure correct transmission of the differential signal, and driving is completed.

The EMI can be effectively reduced by the driving method for reducing electromagnetic interference when the differential signal is transmitted in the present technical solution, and a procedure of adjusting the swing value in a development process of a product can be simplified, which can accelerate the development progress of the product. In particular, when data mini-LVDS is transmitted between the timing controller TCON and the source-chip on film S-COF, correct data transmission is ensured, and the EMI is reduced.

The present embodiment is suitable for driving of differential signal transmission between any chips, and the EMI can be reduced effectively. Moreover, a procedure of adjusting the swing value in the development process of a product can be simplified, which can accelerate the development progress of the product.

Embodiment 2

Figure 2:
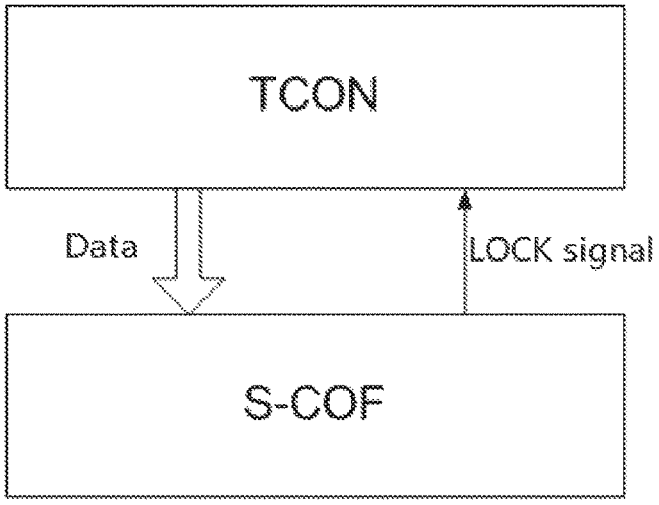
FIG. 2 schematically shows a driving principle of a timing controller TCON and a source-chip on film S-COF.

The present embodiment is described with reference to FIG. 2. The present embodiment provides a driving device for reducing electromagnetic interference, which comprises a first chip and a second chip. The first chip is configured to transmit data to the second chip; when it is determined that data read by the second chip is correct, the first chip works with original data transmission parameters; and when it is determined that the data read by the second chip is incorrect, a swing value of transmission data is adjusted to a higher-grade value. The second chip is configured to determine whether the read transmission data is correct and send a determination result to the first chip, and if the determination result is yes, the second chip works with original data transmission parameters.

Preferably, an initial swing value of the transmission data is arranged to be a minimum value.

Preferably, a step of determining whether the read transmission data is correct is specifically: determining whether data received by the second chip is the same as initial data A built and stored in the second chip; if a determination result is yes, the read transmission data is correct; and if a determination result is no, the read transmission data is incorrect.

Preferably, the first chip is a timing controller TCON, and the second chip is a source-chip on film S-COF.

The present embodiment provides a driving method for reducing electromagnetic interference in a TFT-LCD device, and the driving method is implemented based on the timing controller TCON and the source-chip on film S-COF.

In the TFT-LCD device, the timing controller TCON transmits video data, i.e., transmission data mini-LVDS, to an active area via the source-chip on film S-COF. In the present embodiment, it is ensured that the EMI has a minimum value when correct mini-LCDS can be transmitted to the source-chip on film S-COF by the timing controller TCON.

In the present embodiment, comparison of transmission data received by the source-chip on film S-COF with initial data A built in the source-chip on film S-COF is performed so as to determine whether the data received is correct. If the data received is incorrect, the timing controller TCON makes a corresponding adjustment to a swing value of the transmission data mini-LVDS so as to obtain a minimum swing value which ensures that the source-chip on film S-COF can read the data smoothly.

The specific process is as follows. A working procedure of the source-chip on film S-COF is as follows. Initial data A is stored in the source-chip on film S-COF. At each time of turn on, a Lock signal is at a logic voltage low level initially, and the source-chip on film S-COF receives a first row of data transmitted by the timing controller TCON; when data received by the source-chip on film S-COF is different from initial data A built in the source-chip on film S-COF, the Lock signal is still output at the logic voltage low level, and the source-chip on film S-COF continues to receive a next row of data; and when the data received by the source-chip on film S-COF is the same as the initial data A built in the source-chip on film S-COF, the Lock signal is output at a logic voltage high level, and the source-chip on film S-COF starts to work normally with original data transmission parameters.

A working procedure of the timing controller TCON is as follows. At each time of turn-on, the timing controller TCON first outputs the initial data A stored in the source-chip on film S-COF; when the timing controller TCON detects that the Lock signal is at a low level, the timing controller TCON adjusts a swing value of the transmission data mini-LVDS to a higher-grade value and outputs initial data A again; and when the timing controller TCON detects that the Lock signal is at a high level, the timing controller TCON starts to work normally and transmits data to the source-chip on film S-COF.

In the present embodiment, the wing value of the transmission data mini-LVDS is arranged to be a minimum value. At each time of turn-on, if the source-chip on film S-COF cannot read data correctly, the Lock signal is at a low level, and the timing controller TCON adjusts the swing value to a higher-grade value until the source-chip on film S-COF can read the data correctly. When the source-chip on film S-COF can read the data correctly, the swing value of the transmission data mini-LVDS has a minimum value which ensures that the source-chip on film S-COF of a sample can read the data smoothly.

The EMI can be reduced by the driving device for reducing electromagnetic interference in the present technical solution, and a procedure of adjusting the swing value in a development process of a product can be simplified, which can accelerate the development progress of the product. In particular, when the transmission data mini-LVDS is transmitted between the timing controller TCON and the source-chip on film S-COF, correct data transmission is ensured, and the EMI is reduced.

To sum up, the minimum swing value of the transmission data mini-LVDS can be obtained based on performance of a timing controller TCON and a source-chip on film S-COF in each sample so as to reduce the EMI.

The driving method in the present embodiment can be written into software programs, and corresponding functions can be embedded into the timing controller TCON and the source-chip on film S-COF so as to achieve the driving device.

Although the present disclosure is described hereinabove with reference to specific embodiments, it can be understood that, these embodiments are merely examples of the principles and applications of the present disclosure. Hence, it can be understood that, numerous modifications can be made to the embodiments, and other arrangements can be made, as long as they do not go beyond the spirit and scope of the present disclosure as defined by the appended claims. It can be understood that, different dependent claims and features described herein can be combined in a manner different from those described in the initial claims. It can also be understood that, the technical features described in one embodiment can also be used in other embodiments.

The invention claimed is:

1. A driving method for reducing electromagnetic interference, which is provided as:

when a second chip determines that data transmitted from a first chip is correct and a swing value of transmission data is a minimum value, the first chip and the second chip work with original data transmission parameters;

and when the second chip determines the data transmitted from the first chip as incorrect, a swing value of the transmission data is adjusted to a higher-grade value until the second chip determines the data transmitted from the first chip as correct;

wherein an initial swing value of the transmission data is arranged to be a minimum value;

wherein a criterion for the second chip to determine the data transmitted from the first chip as correct is that data received by the second chip is the same as initial data A built and stored in the second chip;

wherein the first chip is a timing controller TCON, and the second chip is a source-chip on film S-COF.

2. The driving method for reducing electromagnetic interference according to claim 1, wherein procedures for driving the source-chip on film S-COF and the timing controller TCON are:

at each time of turn-on, a Lock signal of the source-chip on film S-COF is at a logic voltage low level initially, and the source-chip on film S-COF receives a first row of data transmitted by the timing controller TCON; when data received by the source-chip on film S-COF is different from initial data A built in the source-chip on film S-COF, the Lock signal is still output at the logic voltage low level, and the source-chip on film S-COF continues to receive a next row of data; and when the data received by the source-chip on film S-COF is the same as the initial data A built in the source-chip on film S-COF, the Lock signal is output at a logic voltage high level, and the source-chip on film S-COF works with original data transmission parameters; and at each time of turn-on, the timing controller TCON first outputs the initial data A stored in the source-chip on film S-COF; when the timing controller TCON detects that the Lock signal is at a low level, the timing controller TCON adjusts a swing value of transmission data mini-LVDS to a higher-grade value and outputs initial data A again; and when the timing controller TCON detects that the Lock signal is at a high level, the timing controller TCON works with original data transmission parameters and transmits data to the source-chip on film S-COF.

3. A driving device for reducing electromagnetic interference, comprising a first chip and a second chip, wherein the first chip is configured to transmit data to the second chip; when it is determined that data read by the second chip is correct, the first chip works with original data transmission parameters; and when it is determined that the data read by the second chip is incorrect, a swing value of transmission data is adjusted to a higher-grade value; and wherein the second chip is configured to determine whether the read transmission data is correct and send a determination result to the first chip, and if the determination result is yes, the second chip works with original data transmission parameters;

wherein an initial swing value of the transmission data is arranged to be a minimum value;

wherein a step for determining whether the read transmission data is correct is specifically:

determining whether data received by the second chip is the same as initial data A built and stored in the second chip; if a determination result is yes, the read transmission data is correct and if a determination result is no, the read transmission data is incorrect wherein the first chip is a timing controller TCON, and the second chip is a source-chip on film S-COF.

4. The driving device for reducing electromagnetic interference according to claim 3, wherein a specific driving procedure of the source-chip on film S-COF is:

at each time of turn on, a Lock signal is at a logic voltage low level initially, and the source-chip on film S-COF receives a first row of data transmitted by the timing controller TCON; when data received by the source-chip on film S-COF is different from initial data A built in the source-chip on film S-COF, the Lock signal is still output at the logic voltage low level, and the source-chip on film S-COF continues to receive a next row of data; and when the data received by the source-chip on film S-COF is the same as the initial data A built in the source-chip on film S-COF, the Lock signal is output at a logic voltage high level, and the source-chip on film S-COF works with original data transmission parameters; and wherein a specific driving procedure of the timing controller TCON is:

at each time of turn-on, the timing controller TCON first outputs the initial data A stored in the source-chip on film S-COF; when it is detected that the Lock signal is at a low level, the timing controller TCON adjusts a swing value of transmission data mini-LVDS to a higher-grade value and outputs initial data A again; and when it is detected that the Lock signal is at a high level, the timing controller TCON works with original data transmission parameters and transmits data to the source-chip on film S-COF.

* * * * *